US007032489B1

(12) United States Patent
Lin

(10) Patent No.: US 7,032,489 B1
(45) Date of Patent: Apr. 25, 2006

(54) MULTIPURPOSE CUTTING APPARATUS

(76) Inventor: Tsai-Lian Chen Lin, No. 6, Ming De St. Hua Tan Hsiang, Chang Hua Hsien (TW)

( * ) Notice: Subject to any disclaimer, the term of this patent is extended or adjusted under 35 U.S.C. 154(b) by 0 days.

(21) Appl. No.: 10/992,298

(22) Filed: Nov. 18, 2004

(51) Int. Cl.
*B26D 1/18* (2006.01)

(52) U.S. Cl. ..... 83/485; 83/614; 83/564; 83/578

(58) Field of Classification Search ..... 83/614, 83/485, 607, 455, 564, 588, 489, 508, 454, 83/487, 488, 620, 634, 578
See application file for complete search history.

(56) References Cited

U.S. PATENT DOCUMENTS

| | | | | | |
|---|---|---|---|---|---|
| 2,265,498 | A * | 12/1941 | Stancliff et al. | ..... | 242/527.5 |
| 3,532,018 | A * | 10/1970 | Szabo | ..... | 83/455 |
| 3,779,119 | A * | 12/1973 | Broides | ..... | 83/581 |
| 3,973,459 | A * | 8/1976 | Stowe | ..... | 83/455 |
| 5,322,001 | A * | 6/1994 | Boda | ..... | 83/485 |
| 5,802,942 | A * | 9/1998 | Cornell et al. | ..... | 83/455 |
| 5,996,459 | A * | 12/1999 | Cornell et al. | ..... | 83/485 |
| 6,098,515 | A * | 8/2000 | Daley, Jr. | ..... | 83/485 |
| 6,776,077 | B1 * | 8/2004 | Chen | ..... | 83/455 |
| 6,786,123 | B1 * | 9/2004 | Chen | ..... | 83/485 |
| 2002/0092396 | A1 * | 7/2002 | Hsiao | ..... | 83/454 |
| 2003/0154835 | A1 * | 8/2003 | Nunez et al. | ..... | 83/614 |
| 2004/0149108 | A1 * | 8/2004 | McLean et al. | ..... | 83/614 |
| 2004/0221703 | A1 * | 11/2004 | Loibl | ..... | 83/485 |

* cited by examiner

*Primary Examiner*—Allan N. Shoap
*Assistant Examiner*—Ghassem Alie
(74) *Attorney, Agent, or Firm*—Charles E. Baxley

(57) ABSTRACT

The present invention relates to a multipurpose cutting apparatus having a straight cutter and a multipurpose cutter disposed at either side of the cutting table, the cutting table is provided with two pairs of lateral slide grooves in each of received an adjusting assembly. In addition to straight cutting line, the present invention is also able to make different cutting lines by using the multipurpose cutter. The adjusting assembly is disposed at either end of the rail of the multipurpose cutter. Thereby, not only the multipurpose cutter can be adjusted flexibly, but also the multipurpose cutter can be selectively used according to needs.

6 Claims, 6 Drawing Sheets

MULTIPURPOSE CUTTING APPARATUS

BACKGROUND OF THE INVENTION

1. Field of the Invention

The present invention relates to a cutting apparatus, and more particularly to a multipurpose cutting apparatus comprising a cutting table, a straight cutter, a multipurpose cutter and two adjusting assemblies.

2. Description of the Prior Arts

A conventional paper cutter sold on the market generally comprises a cutting table and a straight cutter which is moveable on the rail of the cutting table. The cutting strength of this conventional paper cutter is great, however, the straight cutter is only able to cut the paper in straight lines, and the user has to use other cutters if when a curve line is required to made. Thus, the applicability of the conventional paper cutter is limited.

The present invention has arisen to mitigate and/or obviate the afore-described disadvantages.

SUMMARY OF THE INVENTION

The primary objective of the present invention is to provide a multipurpose cutting apparatus having a straight cutter and a multipurpose cutter disposed at either side of the cutting table, the cutting table is provided with two lateral slide grooves in each of which received an adjusting assembly. In addition to straight cutting line, the present invention is also able to make different cutting lines by using the multipurpose cutter.

The secondary objective of the present invention is to provide a multipurpose cutting apparatus having a straight cutter and a multipurpose cutter disposed at either side of the cutting table, at either end of the rail of the multipurpose cutter is disposed the adjusting assembly which is moveable in the lateral side grooves. Through this way, the multipurpose cutter not only will be adjusted flexibly, but also can be selectively used according to needs.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
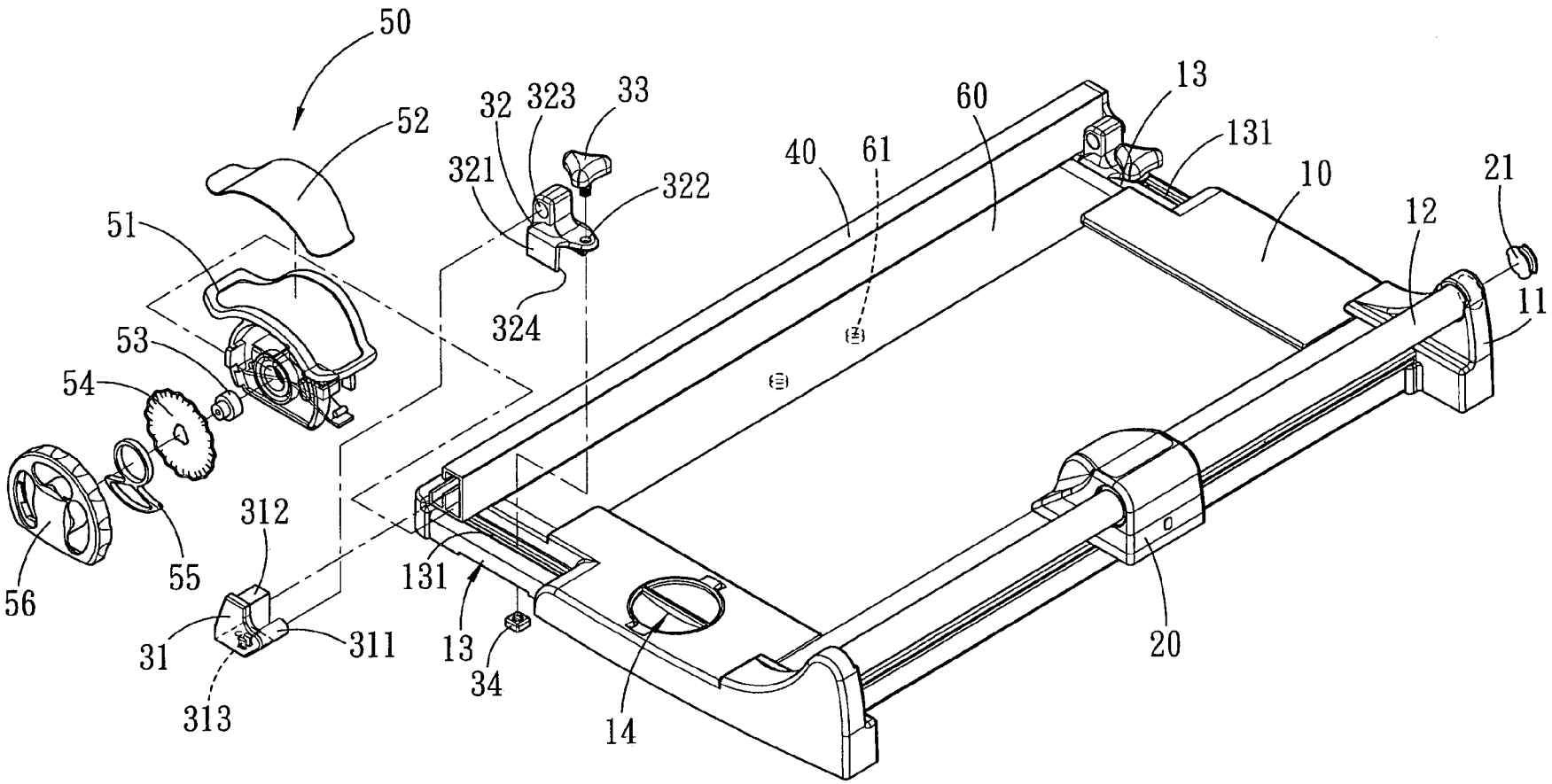
FIG. 1 is an exploded view of a multipurpose cutting device in accordance with the present invention.
Figure 2:
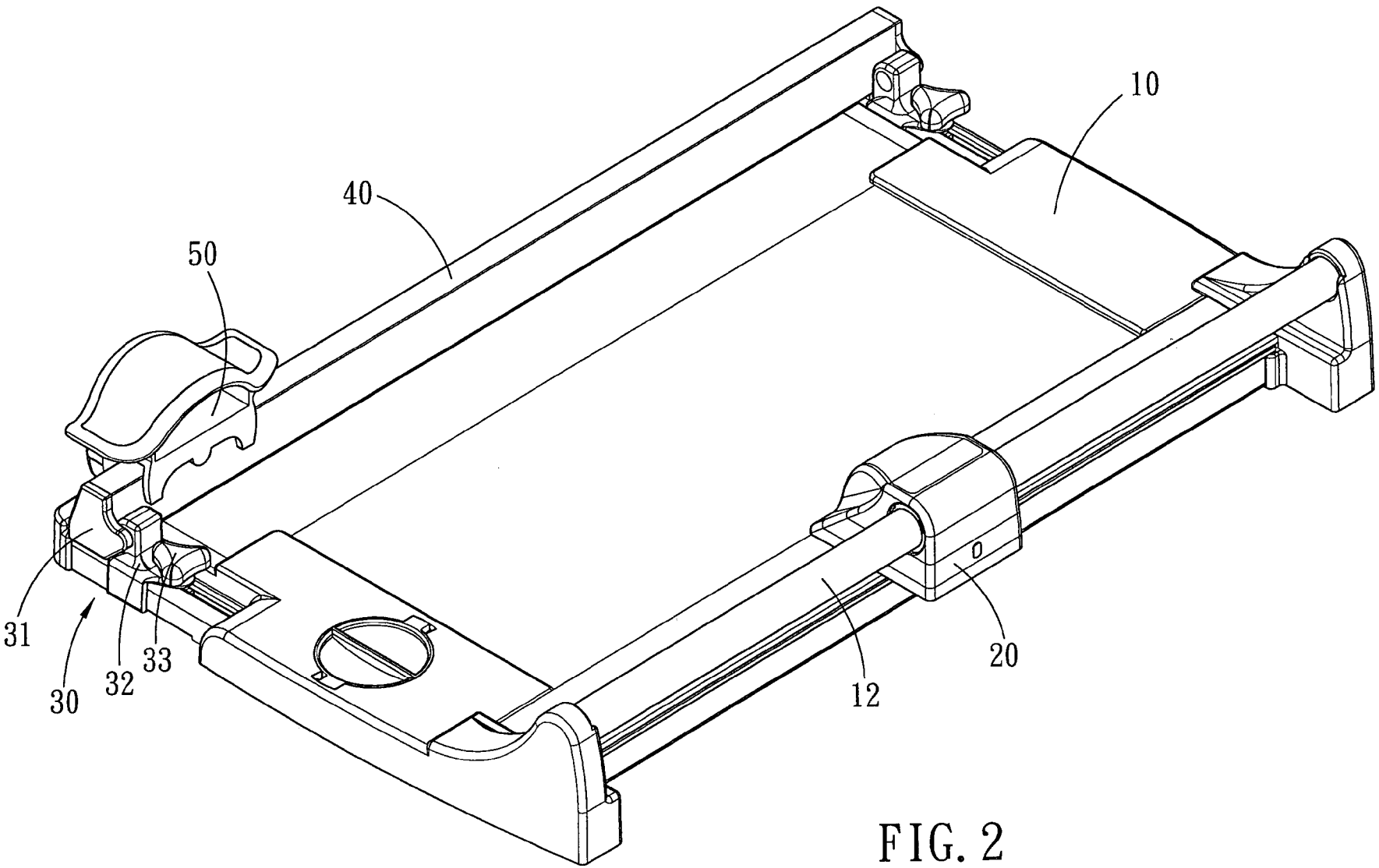
FIG. 2 is an assembly view of the multipurpose cutting device in accordance with the present invention.
Figure 3:
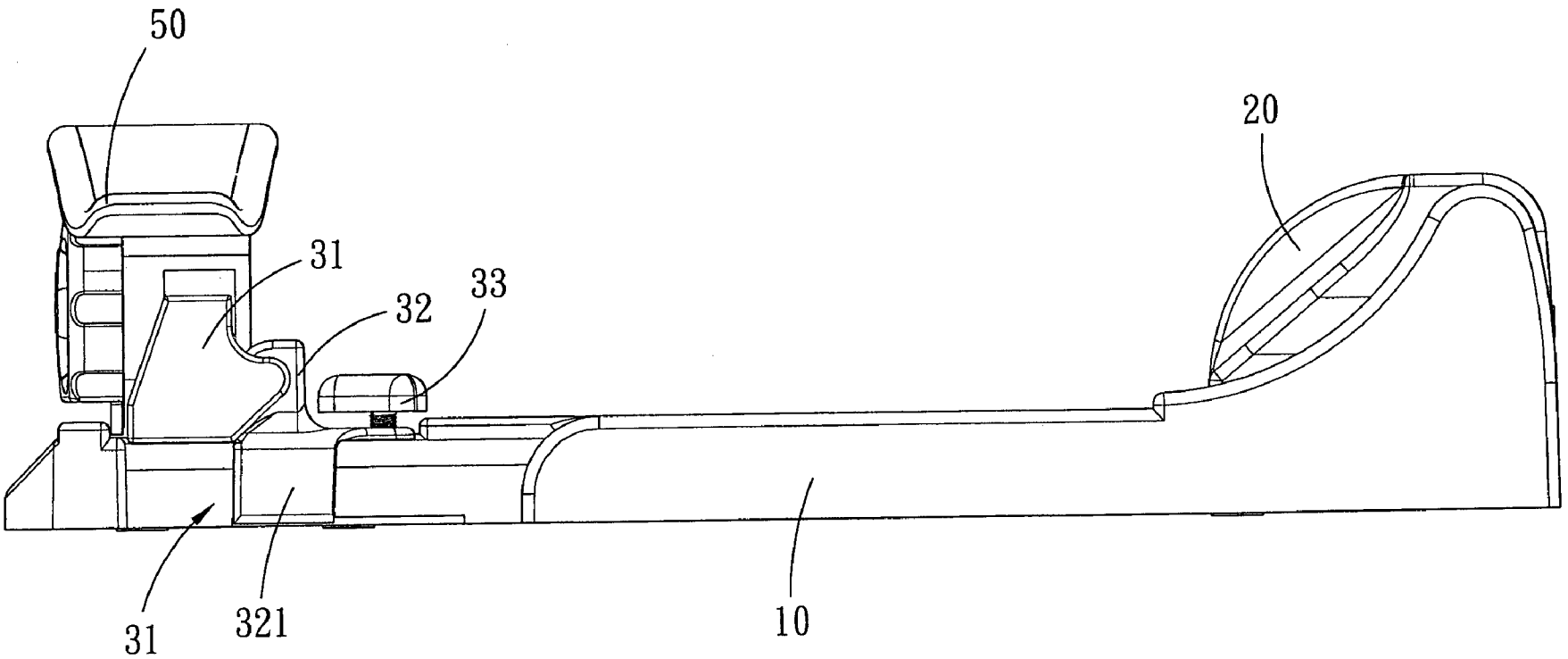
FIG. 3 is a side view of the multipurpose cutting device in accordance with the present invention.
Figure 4:
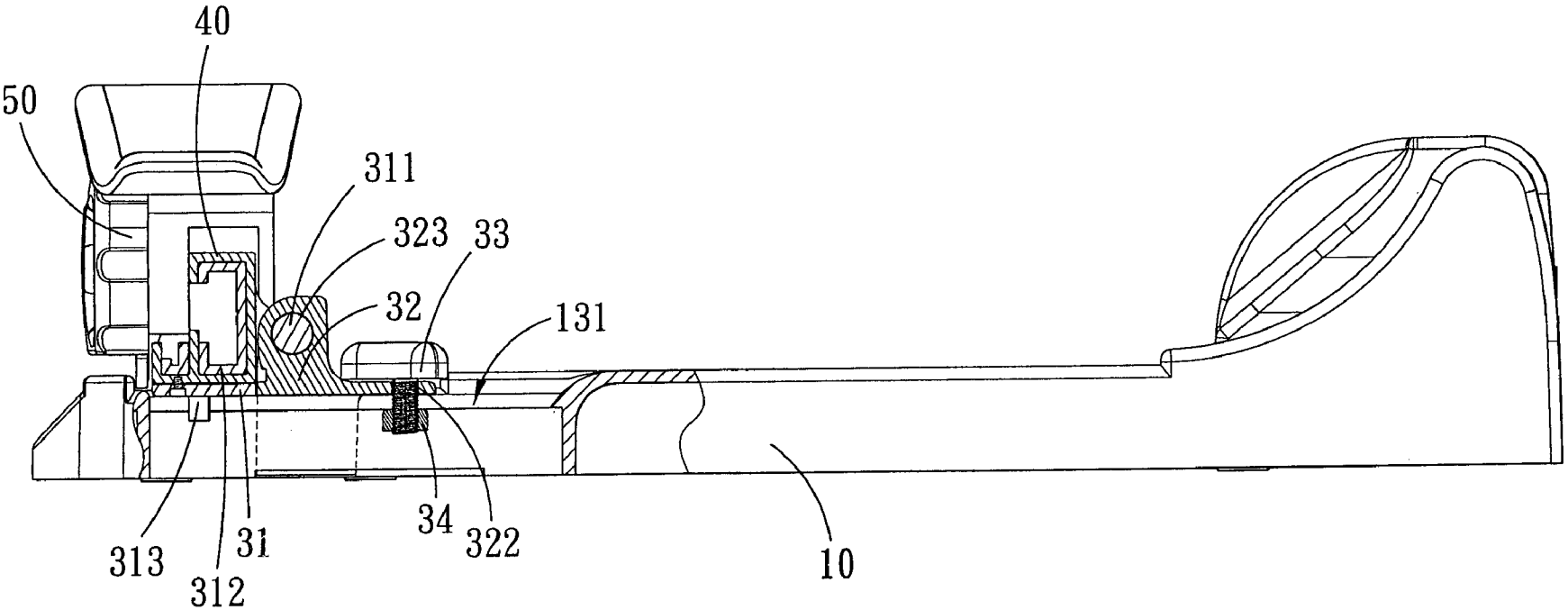
FIG. 4 is a cross sectional view of the multipurpose cutting device in accordance with the present invention.

Referring to FIGS. 1–4, a multipurpose cutting apparatus in accordance with a preferred embodiment of the present invention is shown and comprises: a cutting table 10, a straight cutter 20, two adjusting assemblies 30, a second rail 40 and a multipurpose cutter 50.

The cutting table 10 is oblong-shaped is provided at either end thereof with a rail seat 11, and a first rail 12 disposed between the two rail seats 11. At both ends of the cutting table 10 opposite the two rail seats 11 are provided a pair of lateral-slide grooves 13, respectively. A positioning groove 131 is formed between each pair of the lateral-slide grooves 13. On the surface of the cutting table 10 is provided a cutting pad 60 which is made of cut-resistant material and located between the two pairs of lateral-slide grooves 13. A plurality of through holes 61 are formed on the cutting table 10 in response to the cutting pad 60, and a chamber 14 is formed at a side of the cutting table 10 for storage of cutter blades.

The straight cutter 20 is movably and detachably mounted on the first rail 12 of the cutting table 10 to cut the objects (such as: paper, film, and etc) in straight line, and the straight cutter 20 can be dissembled from the first rail 12 by removing the fixing member 21.

The two adjusting assemblies 30 are fixed in the lateral-slide grooves 13 of the cutting table 10, respectively, and each of the adjusting assemblies 30 comprises a base 31, a slide member 32, a positioning member 33 and a nut 34.

The slide member 32 has a reverse U-shaped leg 321 slidably engaged in the lateral-slide grooves 13, and a locking end 324 of the reverse U-shaped leg 321 is located at the bottom of the lateral-slide grooves 13. A vertical positioning hole 322 and a horizontal pivot hole 323 are formed in the slide member 32, respectively.

The positioning member 33 is screwed with the nut 34 after passing through the vertical positioning hole 322 of the slide member 32 and the positioning groove 131 of the cutting table 10, so as to control the movement of the slide member 32.

The base 31 is provided at an end thereof with a horizontal pin 311 which is inserted in the horizontal hole 323 of the slide member 32, and is further provided with a horizontal projection 312. The horizontal projections 312 of the bases 31 of the two adjusting assemblies 30 are located opposite each other.

The second rail 40 is disposed between the horizontal projections 312 of the bases 31 of the two adjusting assemblies 30, and is provided in the direction of the surface of the cutting table 10 with an antiskid unit, such as sponge (not shown).

The multipurpose cutter 50 includes a housing 51, a cover 52, a shaft 53, a cutter blade 54, an elastic member 55 and a lateral cover 56. The housing 51 is slideably mounted on the second rail 40, and the cutter blade 54 can be replaced at any time according to the user's needs.

Figure 5:
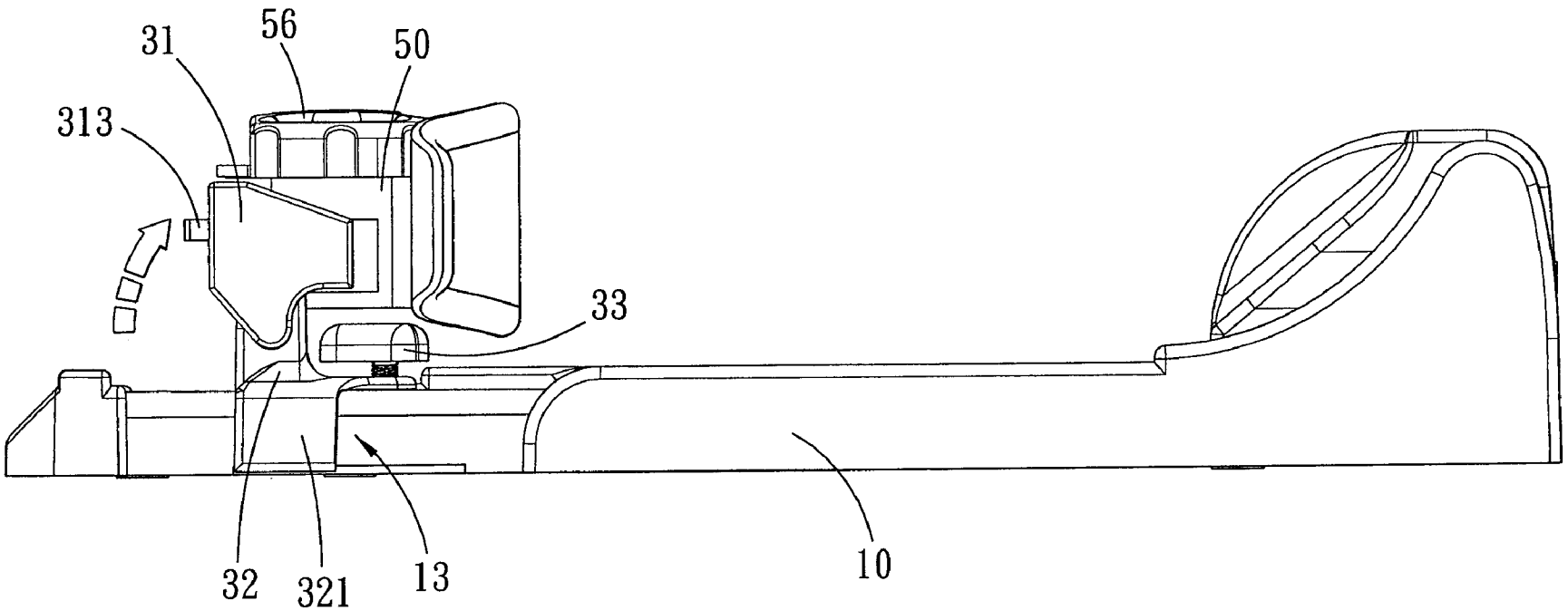
FIG. 5 is an operational view of the multipurpose cutting device in accordance with the present invention.

For a better understanding of the invention, its operating advantages and specific objects attained by its uses, reference should be made to FIG. 5.

To use the straight cutter 20, the user can rotate the base 31 of the adjusting assemblies 30 about the slide member 32, so as to cause the second rail 40 move upward. Meanwhile, the multipurpose cutter 50 is raised upward, and the cutter blade 54 is turned around to face upward. At this moment, the object to be cut (such as paper, film) can be inserted to the cutting table through the space under the multipurpose cutter 50, so as to be cut in straight lines by the straight cutter 20 on the first rail 12.

To use the multipurpose cutter 50, the user only needs to change the cutter blade 54, and then to lower down the multipurpose cutter 50 by adjusting the base 31, so that different cutting lines (such as: wave cut line, all kinds of laces, perforated line, and etc) can be carried out by using different cutter blades 50.

After the multipurpose cutter 50 is turned upward by using the base 31 of the adjusting assemblies 30, the cutting pad 60 will be cleared automatically, furthermore, the user is able to remove the lateral cover 56 and replace the cutter blade 54 easily.

To adjust the multipurpose cutter 50, the positioning member 33 of the adjusting assemblies 30 can be loosened relative to the nut 34, so as to allow the π-shaped leg 321 of the slide member 32 to move along the two lateral-slide grooves 13 (the locking end 324 of the slide member 32 can stabilize the adjusting assemblies 30). After the slide member 32 pushes the second rail 40 to a predetermined position, the user can tighten the positioning member 33 relative to the nut 34, so as to re-fix the second rail 40. By this way, the multipurpose cutter 50 can be adjusted quickly and easily.

It will be noted that the straight cutter 20 and the multipurpose cutter 50 are disposed at both sides of the cutting table 10, respectively, and the multipurpose cutter 50 can be adjusted flexibly, so as to improve the flexibility of the cutter to produce more different sized products.

The adjusting assemblies 30 can enable the multipurpose cutter 50 to be adjusted more flexibly, and the cutting pad 60 is large enough for enabling the object to be cut into different sizes, and the through holes 61 are designed to enable the user to remove the cutting pad 60 by inserting fingers through the through holes 61.

Figure 6:
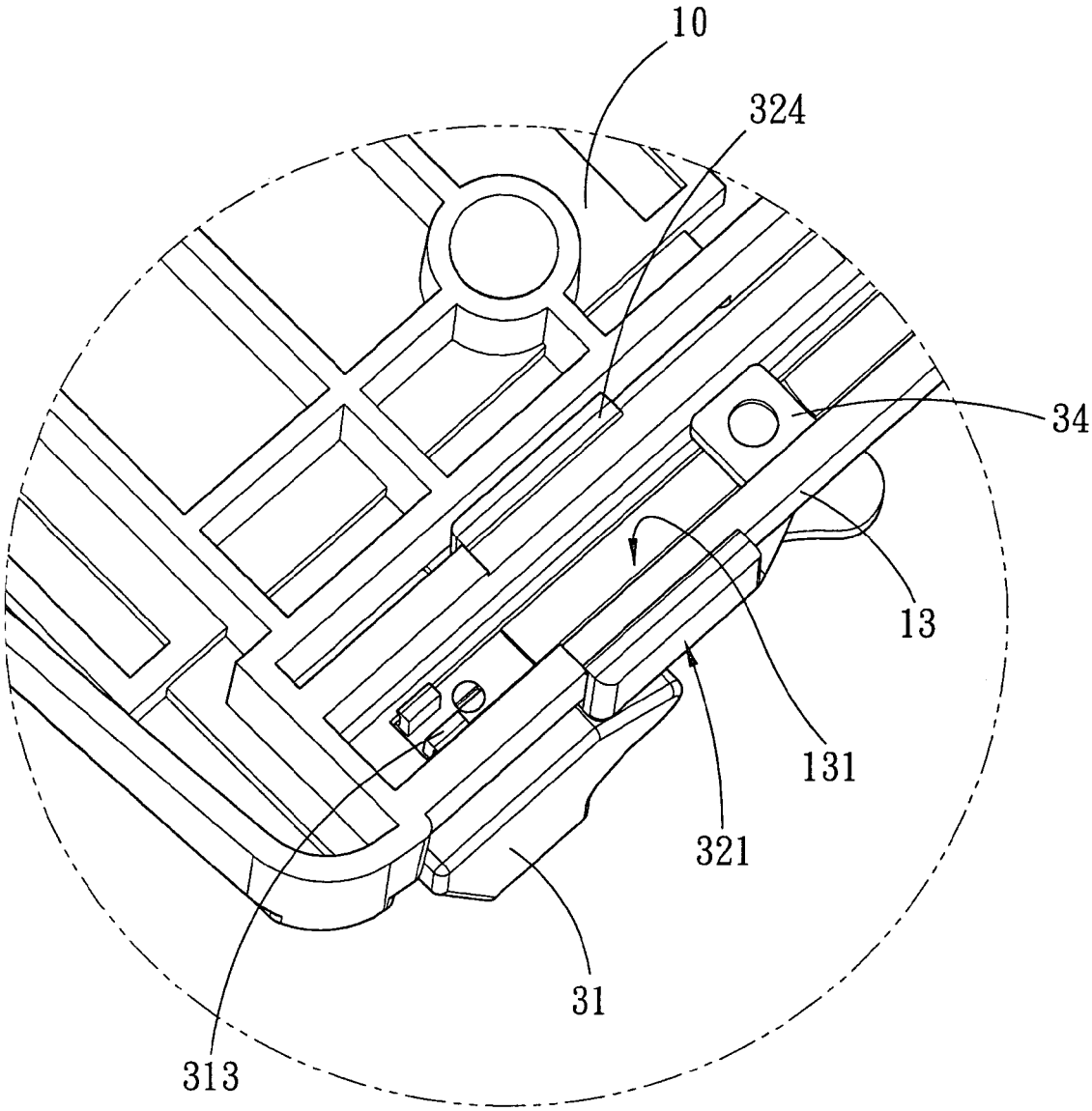
FIG. 6 is an enlarged view of a part of a multipurpose cutting device in accordance with another embodiment of the present invention.

Referring to FIG. 6, which shows a multipurpose cutting apparatus in accordance with another embodiment of the present invention, the multipurpose cutting apparatus of this embodiment is generally similar with that of the first embodiment, and the difference is that each of the bases 31 of the two slide assemblies 30 in this embodiment is provided with a locking bolt 313 which is sized in response to the size of the positioning groove 131 of the cutting table 10, and the locking bolt 313 is inserted in the positioning groove 131. This locking bolt 313 is designed to enable the base 31 of the two adjusting members 30 to be positioned in the positioning groove 131 more stably (enabling the second rail 40 to be positioned firmly), so that the multipurpose cutter 50 can be prevented from oscillation during operation, thus improving the processing effect.

It is to be noted that the second rail 40 also can be disassembled easily.

While we have shown and described various embodiments in accordance with the present invention, it should be clear to those skilled in the art that further embodiments may be made without departing from the scope of the present invention.

What is claimed is:

1. A multipurpose cutting apparatus comprising:

a straight cutter moveably mounted on a cutting table, at either side of the cutting table opposite the straight cutter formed a pair of lateral slide grooves, and between each pair of the lateral slide grooves disposed a positioning groove;

two adjusting assemblies disposed in the two pairs of lateral slide grooves of the cutting table, each of the adjusting assemblies including a base, a slide member, a positioning member and a nut, the slide member having a leg slidably engaged in the lateral-slide grooves, and the slide member provided with a vertical positioning hole and a horizontal pivot hole, respectively, the positioning member being screwed with the nut after passing through the vertical positioning hole of the slide member and the positioning groove of the cutting table, so as to control the movement of the slide member, the base provided at an end thereof with a horizontal pin to be inserted in the horizontal hole of the slide member, the bases of the two adjusting assemblies located opposite each other;

a rail disposed between the bases of the two adjusting assemblies;

a multipurpose cutter moveably mounted on the rail.

2. The multipurpose cutting apparatus as claimed in claim 1, wherein the cutting table is oblong-shaped, and on the surface of the cutting table are provided a cutting pad made of cut-resistance material.

3. The multipurpose cutting apparatus as claimed in claim 1, wherein each of the adjusting assemblies is provided with a horizontal projection, the horizontal projections are opposite each other, and the rail is disposed between the two horizontal projections.

4. The multipurpose cutting apparatus as claimed in claim 1, wherein the multipurpose cutter includes a housing, a cover, a shaft, a cutter blade, an elastic member and a lateral cover, the housing is slideably mounted on the rail, and the cutter blade is allowed to be replaced after the lateral cover is opened.

5. The multipurpose cutting apparatus as claimed in claim 1, wherein the base is provided with a locking bolt which is sized in response to the positioning groove of the cutting table, and the locking bolt is inserted in the positioning groove for positioning the multipurpose cutter more stably.

6. The multipurpose cutting apparatus as claimed in claim 1, wherein a chamber is formed at a side of the cutting table for storage of blades.

* * * * *